US005720383A

United States Patent [19]

Glover

[11] Patent Number: 5,720,383

[45] Date of Patent: Feb. 24, 1998

[54] COLLECTING CONTAINERS

[75] Inventor: Edward Charles Timothy Samuel Glover, London, England

[73] Assignee: Eastman Kodak Company, Rochester, N.Y.

[21] Appl. No.: 643,244

[22] Filed: May 3, 1996

[30] Foreign Application Priority Data

May 4, 1995 [GB] United Kingdom ..... 9509078
Jul. 15, 1995 [GB] United Kingdom ..... 9514533

[51] Int. Cl.[6] ..... B65D 5/72

[52] U.S. Cl. ..... 206/223; 220/403; 220/890

[58] Field of Search ..... 220/403, 407, 220/409, 578, 579, 666, 694, 890; 206/578, 223, 219

[56] References Cited

U.S. PATENT DOCUMENTS

| | | | |
|---|---|---|---|
| 3,874,189 | 4/1975 | Calim | 220/403 |
| 4,054,223 | 10/1977 | Marques | 220/403 |
| 4,119,263 | 10/1978 | Cuthbertson et al. | 220/403 |
| 5,199,594 | 4/1993 | Obara et al. | 220/403 |

FOREIGN PATENT DOCUMENTS

| | | | |
|---|---|---|---|
| 0 227 358 B1 | 12/1986 | European Pat. Off. . | |
| 0 276 994 | 1/1988 | European Pat. Off. | B65D 77/06 |
| 0 500 371 A2 | 2/1992 | European Pat. Off. . | |
| 2647919 | 5/1990 | France . | |
| 1363136 | 8/1970 | United Kingdom . | |

*Primary Examiner*—Joseph M. Moy
*Attorney, Agent, or Firm*—Charles E. Snee, III

[57] ABSTRACT

It is known to use 'bag-in-box' arrangements both for supplying photographic processing solutions to a photographic process and for collecting effluent therefrom. However, a supply 'bag-in-box' arrangement may not be completely emptied and when it is transferred to collect effluent, and it may become full before the new supply 'bag-in-box' arrangement has been emptied. This is a problem if there are no empty 'bag-in-box' arrangement to replace the full one collecting effluent. Described herein is a 'bag-in-box' arrangement (10) having a variable effective volume. The arrangement (10) comprises an outer box (12) in which is housed an inner bag (20). Connection to the process is achieved by means of connector (22). A spacer element (28) is located in the top of the outer box (12) which limits the effective volume thereof for transportation. The element (28) is removed when the 'bag-in-box' arrangement (10) is connected to the process to supply solution thereto. Once the inner bag (20) is emptied, it is transferred to collect effluent from the process. The inner bag (20) can now expand in the outer box (12) to substantially fill it thereby providing a larger volume for collection of effluent. In this way, a supply 'bag-in-box' arrangement will always be empty before an effluent 'bag-in-box' arrangement becomes full.

7 Claims, 2 Drawing Sheets

COLLECTING CONTAINERS

FIELD OF THE INVENTION

The present invention relates to improvements in or relating to containers, and is more particularly concerned with 'bag-in-box' arrangements which are used to supply solution to a process and to collect effluent therefrom.

BACKGROUND OF THE INVENTION

It is known to supply processing solutions to a photographic process using a flexible bag having two compartments each having a port connected thereto. One of the compartments contains processing solution for supplying to a photographic process and the other is empty and is designed to receive used processing solution. Such an arrangement is described in FR-A-2 647 919.

It is also known to supply processing solutions from 'bag-in-box' arrangements which comprise an outer liquid-tight container or box inside which a flexible bag containing processing solution is located. The arrangement has two connections—a first connection between the flexible bag and the outside of the container, and a second connection between the outside of the container and the space between the flexible bag and the outer container. Processing solution is fed from the bag via the first connection to an appropriate photographic process, and used processing solution is returned to the container from the process through the second connection. This means that processing solution can be stored in a container, supplied to a process from that container, and returned thereto when used or exhausted for disposal. Such an arrangement is described in GB-A-1 363 136.

Other 'bag-in-box' arrangements are also described in EP-A-0 284 024 and EP-A-0 227 358.

In the flexible bag arrangement and the 'bag-in-box' arrangements described above, at least two connections are provided, one connection through which solution is supplied to the process and one connection through which used or waste solution is collected therefrom.

Other 'bag-in-box' arrangements are known, for example, as described in EP-A-0 500 371, which utilise a single connector between the inner flexible bag and the exterior of the container, the solution being removed from and returned to the inner flexible bag through the single connector.

PROBLEM TO BE SOLVED BY THE INVENTION

In known 'bag-in-box' arrangements for supplying photographic processing solution, it is necessary that the inner bag containing fresh processing solution completely fill the outer box for safety reasons during transportation, that is, to prevent unwanted movement of the inner bag within the outer box during delivery to prevent extra wear on the bag which may eventually prevent leakage of the photographic processing solution contained therein.

However, not all 'bag-in-box' arrangements deliver exactly the same amount of solution to the process. It has been shown that for a 10 liter 'bag-in-box' arrangement, volumes of solution in the range of 10 ml to 450 ml may be left behind when the 'bag-in-box' arrangement is 'empty'. The outcome of this variability on the inlet side to a process when the volume of the outer box is fixed at 10 liter is that when a so-called emptied 'bag-in-box' arrangement, say retaining 300 ml of solution, is moved from the inlet side of the process to the outlet side thereof, the alarm located on the outlet side of the process for effluent collection will be operated before the alarm located on the inlet side of the process if the 'bag-in-box' arrangement connected thereto supplies nearly all of its solution to the process and only retains a volume of solution at the lower end of the range mentioned above. Moreover, this effect is cumulative and large volumes of processing solutions can be wasted.

One way of overcoming this problem is to used 'bag-in-box' arrangement of different volumes for supplying solution to a process and for collecting effluent therefrom, this means that there are then two sets of 'bag-in-box' arrangement or containers which need to the stored at a site where such a process is operated.

Furthermore, it may be the case that two different processes need to be supplied, each process having a different volume processing tank, and that the volumes of the two processors are such that no whole number of 'bag-in-box' arrangement can be used to fill both processors. This means that either expensive processing solution must be discarded or that special individual 'bag-in-box' arrangements are provided containing appropriate volumes of solution. If such 'bag-in-box' arrangements contain less than 10 liter, they cannot be used for the collection of effluent from the process and extra 'bag-in-box' arrangements would need to be provided for effluent collection.

SUMMARY OF THE INVENTION

It is therefore an object of the present invention to provide a 'bag-in-box' arrangement in which the inner bag is full within the outer box for transportation and delivery of solution to a process and in which the outer box can be expanded to contain a greater volume of effluent solution.

In accordance with one aspect of the present invention, there is provided a 'bag-in-box' arrangement for supplying solution to a process and for collecting effluent therefrom, the 'bag-in-box' arrangement comprising an outer box having an inner bag located therein, the inner bag being operable for storing supply solution for the process and then for collecting effluent therefrom, the arrangement including a connector for providing a connection between the inner bag to the process, characterized in that the outer box has a variable effective volume.

Preferably, the outer box includes a spacer element which reduces the volume thereof for storage of the supply solution and which can be modified to increase the volume of the outer box for collection of the effluent. The spacer element may be removable or crushable to increase the effective volume of the outer box. The spacer element may also comprise an air bag which is collapsible to increase the effective volume of the outer box.

The arrangement may also include a lid element mounted inside the outer box against which the spacer element presses, the lid element being movable between two positions which correspond to the difference in the effective volume of the outer box.

Preferably, the outer box includes a tear-off panel for allowing access to the connector.

ADVANTAGEOUS EFFECT OF THE INVENTION

By having a variable effective volume, the 'bag-in-box' arrangement connected to the outlet side of a process never becomes full before the 'bag-in-box' arrangement connected to the inlet side of the process becomes empty.

Moreover, the present invention overcomes the small differences which can occur during the normal supply of processing solutions to a process and effluent collection therefrom.

It also allows for large variations in input or delivery to waste volumes when starting up different processes having different sized processing tanks, thereby precluding the necessity of having to stock a number of different sized outer boxes.

BRIEF DESCRIPTION OF THE INVENTION

For a better understanding of the present invention, reference will now be made, by way of example only, to the accompanying drawings in which.

DETAILED DESCRIPTION OF THE INVENTION

Figure 1:
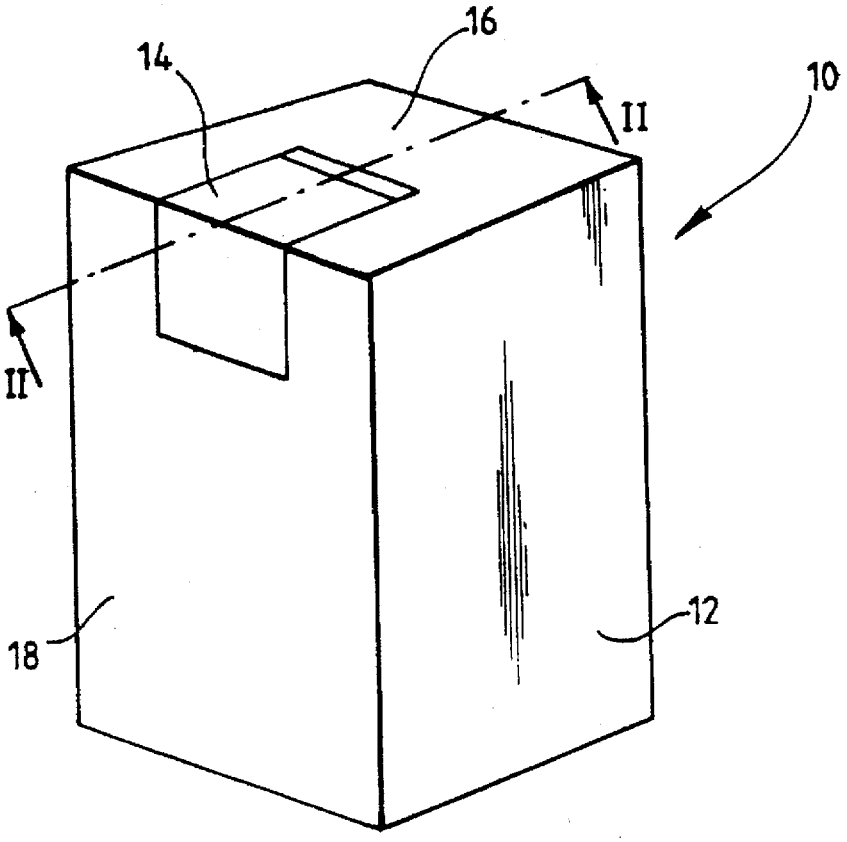
FIG. 1 is a schematic perspective view of a 'bag-in-box' arrangment in accordance with the present invention.

Referring initially to FIG. 1, a 'bag-in-box' arrangement 10 is shown which comprises a substantially rigid outer box 12 of a fixed maximum volume having a tear-out panel 14 located in top wall 16 and side wall 18. Tear-out panel 14 is perforated around its edges for ease of removal.

Figure 2:
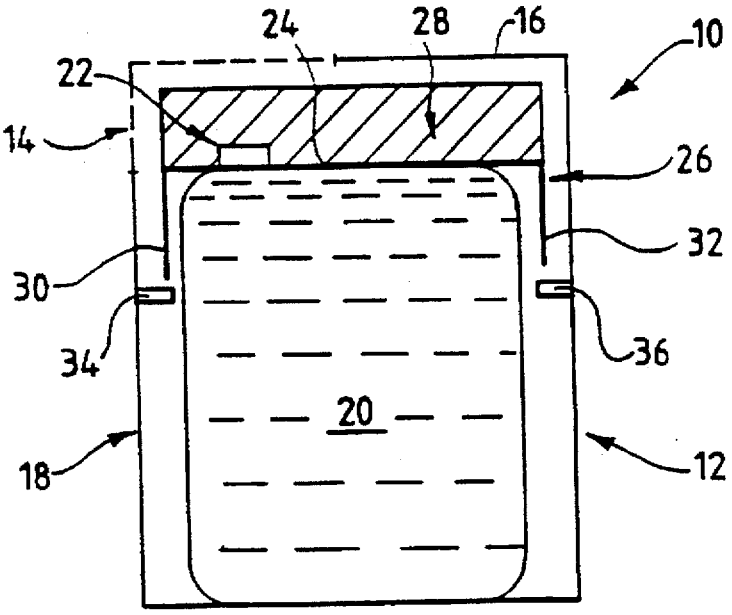
FIG. 2 is a sectioned view taken along lines II—II of FIG. 1.

FIG. 2 illustrates a sectioned view through 'bag-in-box' arrangement 10. A flexible inner bag 20 is positioned within outer box 12 and includes a connector 22 which is provided in top portion 24 of the bag 20. The solution fills the bag 20 to a volume which is less than a selected volume of the bag. Solution is introduced into and removed from the 'bag-in-box' arrangement 10 through connector 22. A movable lid 26 is located over top portion 24 of the inner bag 20 and extends down the sides thereof. A removable spacer element 28 is carried on the lid 26 which spacer element provides a control for contolling the effective volume of the box 12 by determining the volume of the bag 20 which may be filled with liquid. Lower edges 30, 32 of lid 26 rest on ledge portions 34, 36 provided internally of the outer box 12.

Connector 22 may be fixed to movable lid 26 or it may be tucked underneath the lid 26 when supplied. In the latter case, a further tear-out portion (not shown) may be provided in lid 26 so that connector 22 can be drawn therethrough and connected to the process to supply solution thereto.

Figure 3:
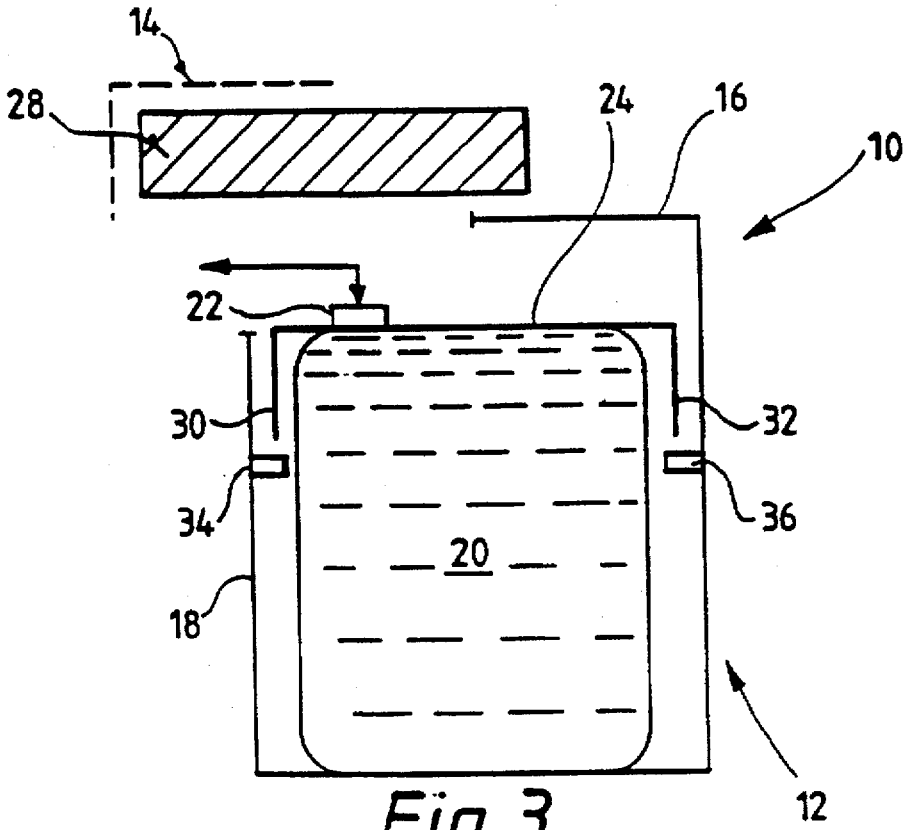
FIG. 3 is similar to FIG. 2 but illustrates the removal of a spacer located within the outer box of the 'bag-in-box' arrangement.

Before the 'bag-in-box' arrangement 10 is used, panel 14 is torn off from top wall 16 and side wall 18 of outer box 12. Spacer 28 is removed. Connector 22 is then connected to the process (not shown) for supplying solution thereto. This is shown in FIG. 3. As shown, it is preferred that lid 26 is aligned with the top of side wall 18 when panel 14 has been removed.

As solution is pumped out of 'bag-in-box' arrangement 10 through connector 22, inner bag 20 collapses, but due to the presence of lid 26, the top 24 of the bag 20 only falls until lower edges 30, 32 of the lid 26 rest on ledge portions 34, 36 which form a stop for preventing movement of the lid toward the inner bag beyond a selected position as the solution is dispensed from the inner bag. The rest of the bag 20 will collapse as solution is drawn out of it.

When the 'bag-in-box' arrangement 10 has been emptied, that is, nearly all of the solution has been removed therefrom, it is disconnected from the inlet side of the process and connected to the outlet side thereof for the collection of effluent. As mentioned above, a greater volume of effluent may be collected than was originally supplied from the 'bag-in-box' arrangement 10 when it was connected to the inlet side of the process. For example, 200 ml to 450 ml may be left in a 10 liter 'bag-in-box' arrangement.

Figure 4:
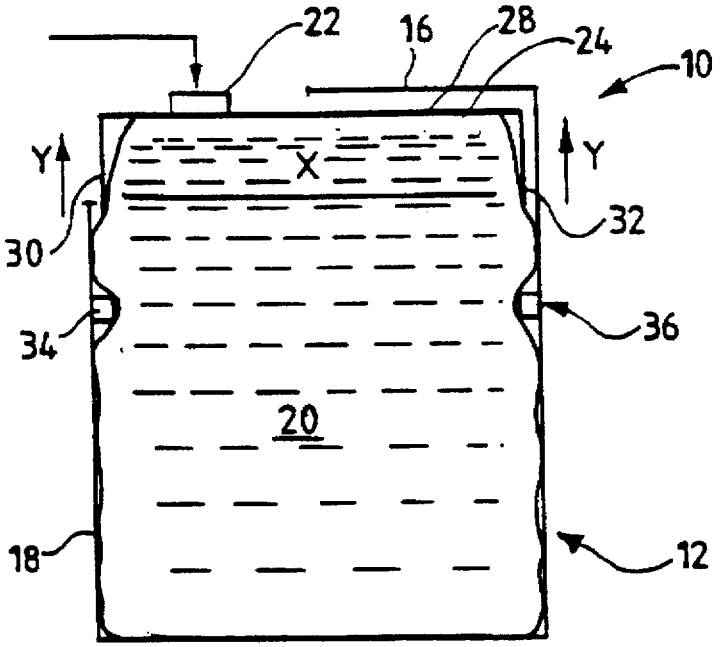
FIG. 4 is similar to FIGS. 2 and 3 but illustrates expansion of the inner bag of the 'bag-in-box' arrangement after the spacer has been removed.

However, due to the removal of spacer 28, the inner bag 20 can expand to accommodate an extra volume of solution, referenced as X in FIG. 4. Lid 26 moves upwards in the direction indicated by arrows Y to provide the extra volume X so that a 'bag-in-box' arrangement connected to the outlet side of a process will always be able to collect effluent until after the 'bag-in-box' arrangement connected to the inlet side of the process has been emptied. This overcomes the situation where the 'bag-in-box' arrangement collecting effluent becomes full before the 'bag-in-box' arrangement supplying solution is emptied and there are no spare empty 'bag-in-box' arrangements available for effluent collection.

Naturally, the inner bag 20 can be made of any suitable size to contain a predetermined amount of solution. However, in accordance with the present invention, the bag 20 is always underfilled when supplied so that it can take any extra effluent to ensure that the 'bag-in-box' arrangement supplying the process becomes empty before the 'bag-in-box' arrangement collecting effluent becomes full.

Smaller volumes of processing solution can be delivered to a process in this way, each 'bag-in-box' arrangement being capable of expanding to collect a greater amount of effluent from a process than solution supplied thereto.

The spacer 28 may be solid and hence is removed from the 'bag-in-box' arrangement before use. Alternatively, the spacer may comprise an air bag which is collapsed prior to solution being dispensed from the 'bag-in-box' arrangement.

Furthermore, the outer box of the 'bag-in-box' arrangement may be deformable to provide more volume in which to collect the effluent.

The 'bag-in-box' arrangement described above can be used in any situation where a solution needs to be supplied and also collected and is not limited to use with photographic processing solutions and their supply to and collection from a photographic process.

Parts List

10 bag-in-box arrangement
12 outer box
14 tear-out panel
16 top wall
18 side wall
20 flexible inner bag
22 connector
24 top portion
26 movable lid
28 removable spacer element
30,32 lower edges
34,36 ledge portions

I claim:

1. A 'bag-in-box' arrangement for supplying solution to a process and for collecting effluent therefrom, the 'bag-in-box' arrangement comprising an outer box of a maximum volume, the outer box having a variable effective volume and having an inner bag located therein; the inner bag having a selected volume and being operable for storing supply solution having a volume less than the selected volume for use in the process, the inner bag then being operable for collecting the effluent from the process; a connector for providing a connection between the inner bag to the process, and the outer box including a spacer element which varies the effective volume of the outer box by reducing the volume of the outer box for storage of the supply solution, which spacer element is modified to increase the effective volume of the outer box for collection of the effluent, whereby the inner bag has the capability of expanding within the outer box up to the maximum volume of the outer box when collecting the effluent.

2. An arrangement according to claim 1, wherein the spacer element is removable from the outer box to increase its effective volume.

3. An arrangement according to claim 1, wherein the spacer element is crushable to increase the effective volume of the outer box.

4. An arrangement according to claim 1, wherein the spacer element comprises an air bag which is collapsible to increase the effective volume of the outer box.

5. An arrangement according to claim 1, wherein the outer box includes a tear-off panel for allowing access to the connector.

6. An arrangement according to claim 1 further comprising a lid disposed between the spacer element and inner bag and a stop engageable by the lid for preventing movement of the lid toward the inner bag beyond a selected position as the solution is dispensed from the inner bag.

7. A 'bag-in-box' arrangement for supplying solution to a process and for collecting effluent therefrom, the 'bag-in-box' arrangement comprising an outer box of a maximum volume and an inner bag located therein; the inner bag having a selected volume and being operable for storing supply solution having a volume less than the selected volume for use in the process, the inner bag then being operable for collecting the effluent from the process; a connector for providing a connection between the inner bag to the process, and the outer box including a spacer element between the inner bag and outer box and a lid element mounted inside the outer box against which the spacer element presses, the lid element being movable between two positions which correspond to the difference in the effective volume of the outer box, whereby the inner bag has the capability of expanding within the outer box up to the maximum volume of the outer box when collecting the effluent.

* * * * *